US009022221B1

(12) United States Patent
Echols

(10) Patent No.: US 9,022,221 B1
(45) Date of Patent: May 5, 2015

(54) GOLD DRY WASHER

(71) Applicant: John D. Echols, Key West, FL (US)

(72) Inventor: John D. Echols, Key West, FL (US)

( * ) Notice: Subject to any disclaimer, the term of this patent is extended or adjusted under 35 U.S.C. 154(b) by 0 days.

(21) Appl. No.: 14/446,000

(22) Filed: Jul. 29, 2014

(51) Int. Cl.
*B07B 13/00* (2006.01)
*B07B 1/30* (2006.01)
*B07B 1/00* (2006.01)

(52) U.S. Cl.
CPC .. *B07B 1/30* (2013.01); *B07B 1/005* (2013.01)

(58) Field of Classification Search
USPC ..... 209/659, 660, 674, 678
See application file for complete search history.

(56) References Cited

U.S. PATENT DOCUMENTS 4,809,880 A * 3/1989 Stein ..... 221/204
4,995,848 A * 2/1991 Goh ..... 453/3
6,758,736 B1 * 7/2004 Ristvedt et al. ..... 453/15

* cited by examiner

*Primary Examiner* — Terrell Matthews
(74) *Attorney, Agent, or Firm* — Christopher J. Vandam, PA; Chris Vandam

(57) ABSTRACT

A gold dry washer comprised of a stand assembly and a trough assembly. The trough assembly is angled from an upper end with a hopper for raw soil to a lower end where denser gold is collected. Along the declining path of the trough are a series of graduating apertures that successively isolate the denser materials in the soil and allow waste to fall overboard. The stand assembly includes a motor or other gentle agitation means to encourage the dry soil to move with the aid of gravity towards the lower end of the trough where the heavier gold may be collected.

3 Claims, 3 Drawing Sheets

GOLD DRY WASHER

BACKGROUND OF THE INVENTION

1. Field of the Invention

The present invention relates to mining, and more particularly, to sorting and separating components of soil.

2. Description of the Related Art

Several designs for gold and mineral isolation devices have been designed in the past. None of them, however, includes the ability to efficiently sort soils without the need of water and can be done in a man portable machine while using, in some versions, a minimal amount of electrical or kinetic energy.

Historically, miners and prospectors could pan in a stream or in other soils in an attempt to find and collect gold and other earth borne materials. Panning is largely a manual endeavor using large, shallow pans that are submerged with soil and shaken to sort out the heavier gold grains from other less dense earthen materials.

More efficient means of isolating the gold, such as sluicing, have been used on small to medium scale. Although these techniques can be done by an individual, they still require copious amounts of water. The sluice process employs directing water and soil to flow through a man-made channel that captures the heavier gold and allows the alluvium or other non-gold bearing soil to wash away.

Sluicing can be highly damaging to the environment including the natural topography that is destroyed as well as contaminating the water and soils with runoff and surplus from the procedure. Historically, significant damage was caused in many fragile environments that have yet to recover.

More commercialized and modern techniques include underground mines and underwater dredging. These too produce risk to the environment on a grand scale as well as dangers to the human workers on those projects. Further, these methods are generally beyond the scope of resources and ability of an individual prospector or micro-mining operator for fun and profit.

Other patents, publications and historical records describe these and other methods of mining in detail. All of this related subject matter provide for a number of more or less complicated and costly aspects and features that fail to solve the problem in an efficient, environmentally conscious and economical way. None of these teachings suggest the novel features of the present invention.

SUMMARY OF THE INVENTION

It is one of the main objects of the present invention to provide an effective and efficient gold dry mining apparatus and technique.

An important object of the device is to provide a device that uses no water to isolate gold from earth materials.

It is another object of this invention to provide an environmentally friendly and user friendly way for separating gold or other materials from dry soils.

It is still another object of the present invention to provide, in at least one version of the device, a man portable device that can be carried to a remote mining site and then can be operated with minimal energy input requirements.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
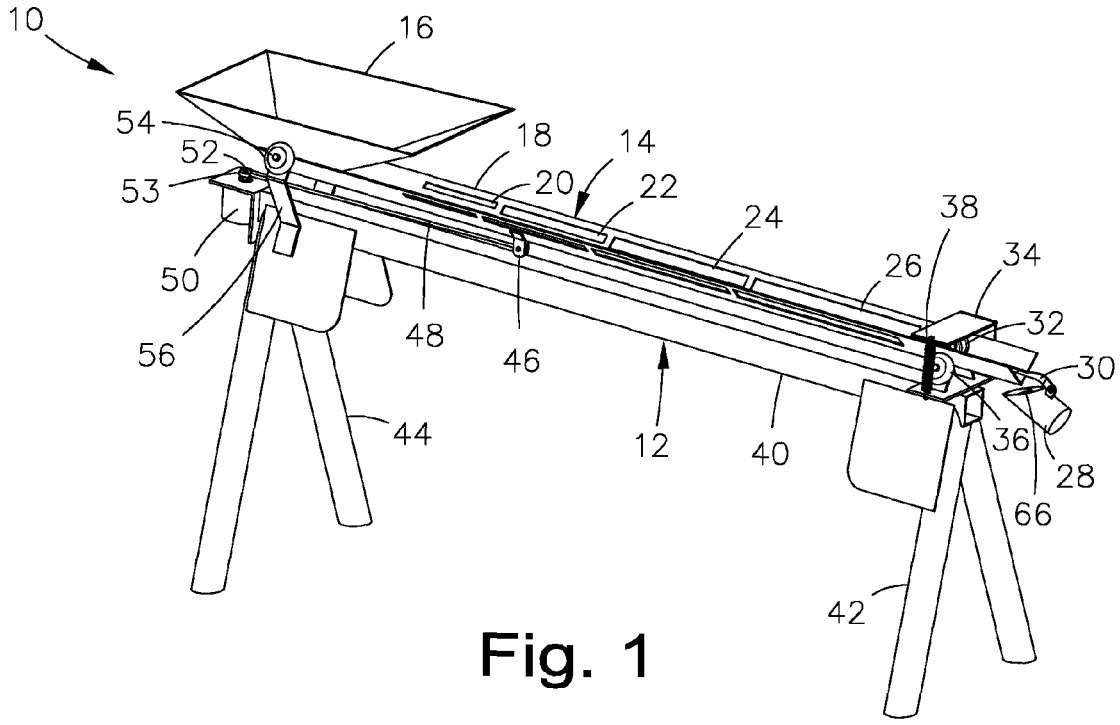
FIG. 1 represents a perspective view of a version of a gold dry washer.
Figure 2:
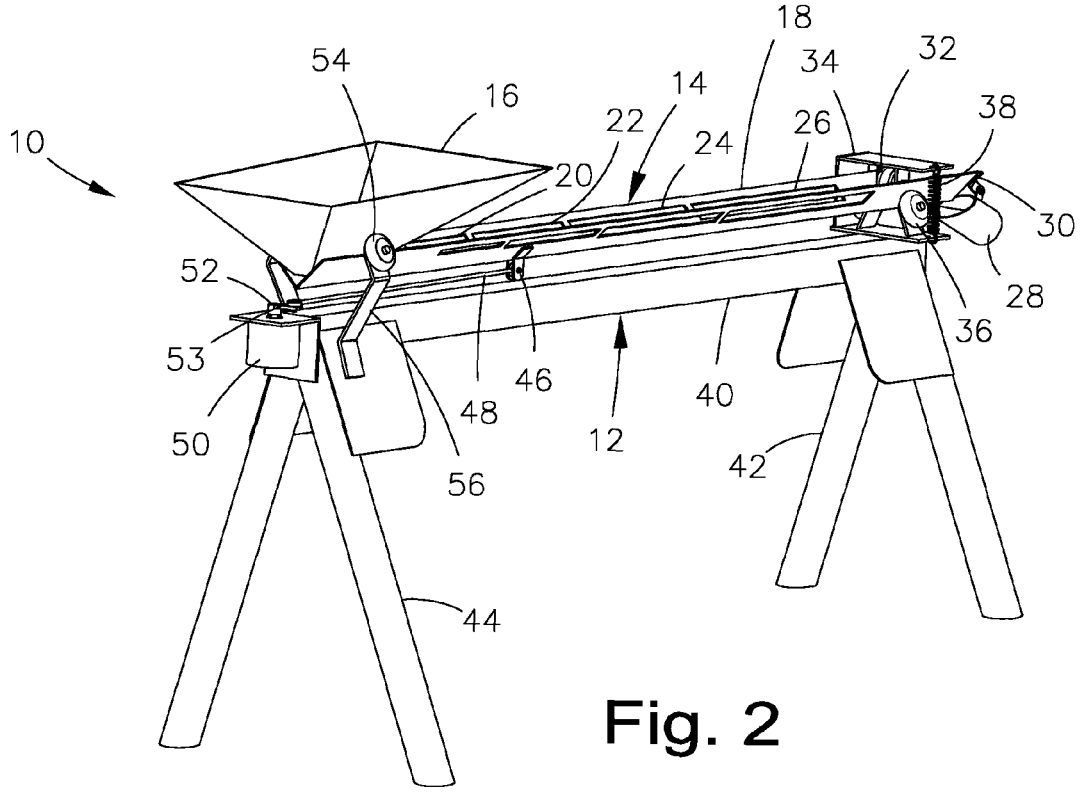
FIG. 2 shows an alternate perspective view a gold dry washer similar to that shown in FIG. 1.

The subject device and method of use is sometimes referred to as the device, the invention, the dry gold washer or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Specific dimensions, proportions, ratios and the like should not be extrapolated from the drawings. Some elements are stylized or otherwise emphasized to more clearly show a particular aspect of the invention or to point out an intended characteristic.

Referring now to the drawings, where the present invention is generally referred to with numeral 10, it can be observed that it basically includes, among other aspects, a stand assembly 12, a trough assembly 14, a hopper 16, a trough 18, a slot 20, a slot 22, a slot 24, a slot 26, a cup 28, an arm 30, a wheel 32, a bracket 34, a wheel 36, a spring 38, a beam 40, legs 42, legs 44, a bracket 46, a rod 48, a motor 50, a crank 52, a bearing 53, a wheel. 54, an arm 56, a hinge 58, a wheel 60, a wheel 62, an arm 64, a baffle 66, a spill 68, a cup 70 and a groove 74.

In a version of the device shown generally in the figures, there are two primary sub-assemblies: the stand assembly 12 and the trough assembly 14. There are several optional components and several superfluous components that are shown or alternatively described herein that may be included or omitted and yet remain within the inventive concept and spirit.

Figure 5:
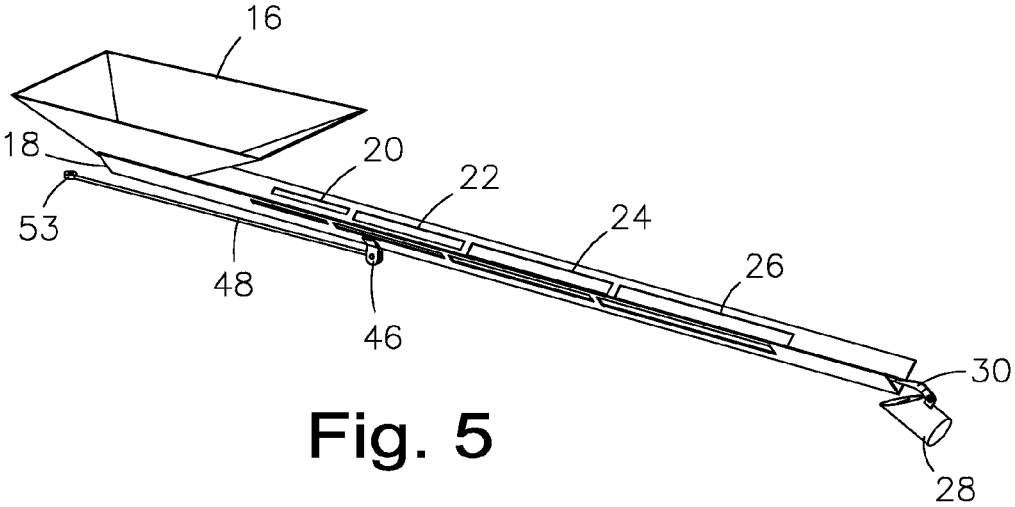
FIG. 5 is a perspective view of an iteration of a trough assembly isolated from other elements of the device.
Figure 6:
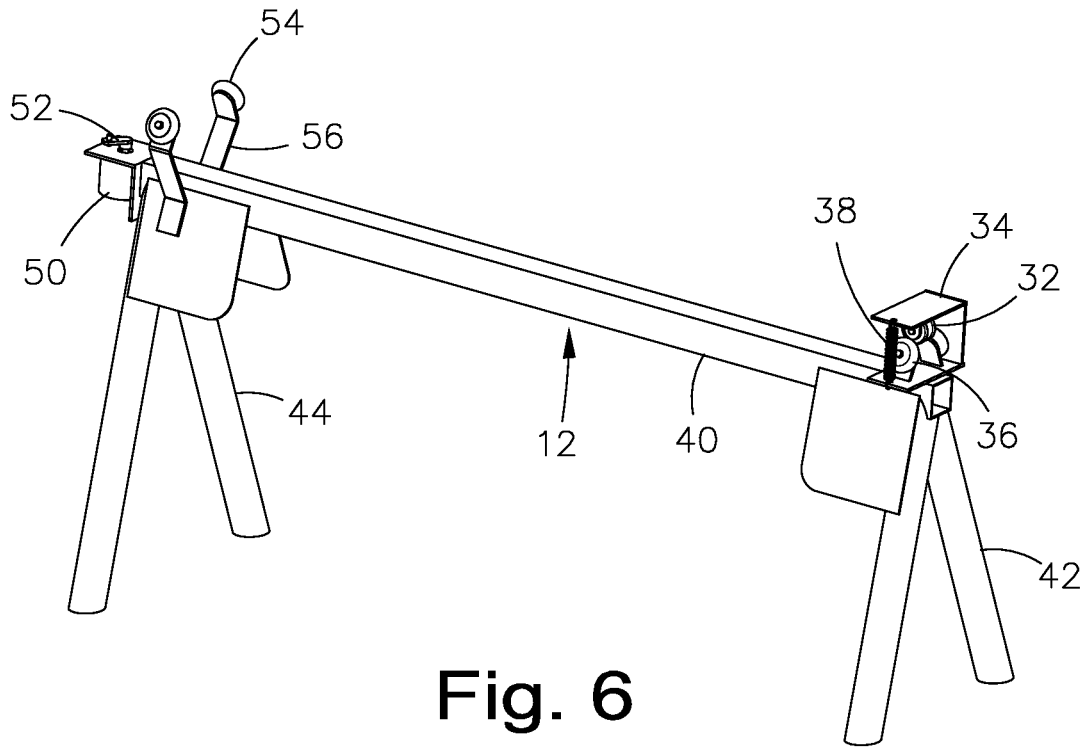
FIG. 6 is a perspective view of an embodiment of a stand assembly separated from a trough assembly.

In a highly portable version of the gold dry washer the stand assembly 12 shown in FIG. 6 is easily separable from the trough assembly 14 shown in FIG. 5. By separating these two primary assemblies the device may be more easily transported by an individual to a remote mining site for use.

In typical operation of the device, the stand assembly 12 is erected on or near the mining site. The trough assembly 14 is then attached to the stand assembly 12. The hopper 16 end of the trough assembly 12 is ideally higher in elevation than the cup 28 end. This can be achieved by placing the stand assembly 12 on a level surface because legs 42 are shorter than legs 44.

In at least one embodiment of the device the legs 42 and legs 44 are adjustable in length independently of each other. Preferably there is a downward slope of the trough 18 from the higher end with the hopper 16 to the lower end with the cup 28.

Further during typical operation, the beam 40 is generally parallel to the bottom of the trough 18. This is not required for operation of the device but has been shown to be particularly efficient and effective design for some applications of the device.

Figure 3:
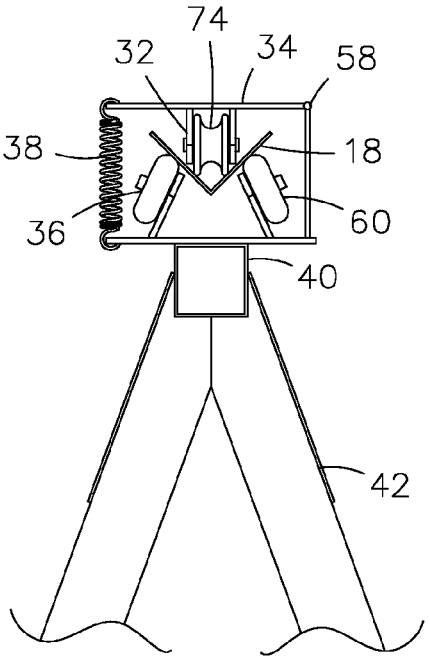
FIG. 3 illustrates an elevation view of a low side of a version of a gold dry washer.

Looking specifically at FIG. 3 where the lower end of the device is shown, the cup 28 has been omitted for clarity. In normal operation the cup 28 or similarly performing apparatus should be present as a collection point for the isolated gold. The legs 42 are also shown truncated on a bottom side.

Still looking at FIG. 3, the lower end of the trough 18 rests on the wheel 36 and wheel 60. Wheel 32 is operably connected to bracket 34 and is held onto the upper surface of the trough 18. The spring 38 biases the bracket 34 and thus the wheel 32 against the trough 18. A hinge 58 is optionally provided integral to the bracket 34.

To facilitate attaching the trough assembly 14 to the frame assembly 12 at the lower end of the trough 18, the spring 38 can be temporarily detached there by allowing the bracket 34 to articulate about the hinge 58 to essentially open the bracket 34. Opening the bracket 34 also moves the wheel 32 out of contact from the trough 18 so that the trough assembly 14 can be readily installed.

Yet referring to FIG. 3, the lower end of the trough 18 rests on wheel 36 on one side and wheel 60 on the other side. When in operation, wheel 32 acts to hold the trough 18 against wheel 36 and wheel 60 yet permit each of wheel 32, wheel 60 and wheel 32 to roll against the trough 18. Each of the wheel 32, wheel 60 and wheel 32 work in concert to permit movement of the trough assembly 14 longitudinally and parallel to the beam 40.

Figure 4:
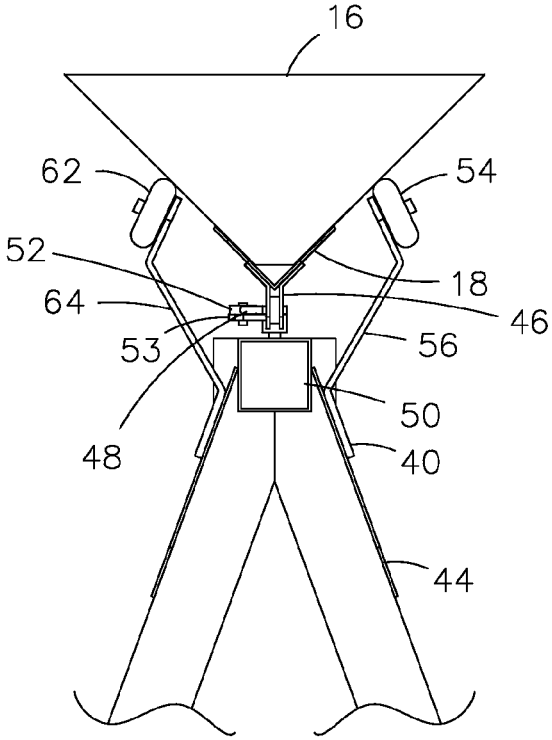
FIG. 4 is a representation of an elevation view of a high side of a version of a gold dry washer.

FIG. 4 is a plan view of the opposite end of the trough assembly 14, also referred to as the higher (or upper) end or side. Again, the legs 44 are truncated in this view. The hopper 16 is shown to be affixed to the higher end of the trough 18. The sides of the hopper 16 are supported by wheel 62 one side and by wheel 54 on the opposing side.

As most clear when reading FIG. 4 in light of FIG. 6, the wheel 62 is operatively connected to the arm 64 that is in turn affixed to the legs 44. Likewise, the wheel 54 is operatively connected to arm 56 that is affixed to the opposing side of the legs 44.

When the device is in operation the wheel 36 and wheel 60 on the lower end of the frame assembly work in concert with the wheel 62 and wheel 54 on the upper end of the frame assembly to permit bidirectional longitudinal movement of the trough assembly along a line substantially parallel to the beam 40 and parallel to the longer dimension of the trough 18 itself.

A motor 50 is attached to the frame assembly 12 near the upper end and near the hopper 16. The motor 50 has a crank 52 attached to the drive shaft of the motor 50. The crank 52 is connected to a bracket 46 integral to the trough assembly 14 at a bearing 53 by a rod 48. The rod 48 transfers energy from the motor 50 on the frame assembly 12 to the trough assembly 14. Because the crank 52 is offset from the shaft of the motor 50 the rod 48 substantially reciprocates and therefore the trough assembly 14 to which the rod 48 is connected also reciprocates.

The length of the reciprocation travel is approximately twice the length of the crank 52. For each rotation of the motor 50 and attached crank 52 the trough assembly 14 longitudinally reciprocates one full back and forth motion cycle. The bearing 53 allows the rod. 48 to travel along its revolving path and to smoothly and efficiently transfer its power from the motor to the trough assembly 14. The bearing 53 may be integral to the lower end of the rod 48.

The trough 18, in an important iteration of the device, is essentially an angled, rigid channel. The bottom inside surface of the trough 18 is generally angular and is continuous from the higher end of the trough 18 to the lower end of the trough 18. The end of the trough 18 at the hopper 16 end of the trough assembly 14 is higher than at the cup 28 end of the trough assembly 14. The angle of the angular bottom of the trough 18 could be between about thirty degrees and one hundred sixty degrees. The angle of the angular bottom can depend on the dimensions of the slots, length of the trough, material being sorted and other factors that affect the other dimensions described herein.

FIG. 5 shows a version of the trough 18 to include a series of progressively dimensioned apertures that are larger at a lower end of the trough 18 and smaller at an upper end of the trough 18. These apertures are identified as slot 20 on the smaller, upper end to slot 26 which is the largest on the lower end of the trough 18.

Slot 20 is the narrowest of the slots on the trough 18 and in at least one version of the device is the shortest slot. Slot 20 is also further away from the angular bottom of the trough 18. The next lower slot 22 represented in FIG. 5 is slightly wider and longer than slot 20. Slot 22 is also closer to the angular bottom of the trough 18. Slot 24 is longer, wider and closer to the angular bottom of the trough than slot 22. In this four slot configuration, slot 26 is wider, longer and closer to the angular bottom of the trough 18 than slot 24.

Even though the figures admit to four slots 20-26, there may be fewer or more slots depending on the nature of the soil that is sorted by the device. Testing has indicated that as few as two slots and as many as a dozen slots can be effective.

The bottom of the hopper 16 is open to the upper edge of the trough 18. When soil is introduced into the hopper 16 gravity draws the soil into the top end of the trough 18 under the hopper 16. With the motor 50 operating, the trough assembly 14 gently reciprocates along the axis of the trough 18. Because the end of the trough 18 opposite the hopper 16 is lower, soil from the hopper 16 gradually flows down the trough 18 towards the low end of the trough 18.

The reciprocating motion of the trough 18 gently agitates the soil and encourages the soil to continue on its downhill path towards the lower end of the trough assembly 14. The agitation also causes heavier, denser particles in the soil, such as gold, migrate toward the angular bottom of the trough 18. The less dense materials in the soil mixture essentially float over the denser gold.

As the yet unseparated soil traverses down the trough 18 from the hopper 16 it passes first the slot 20 where the lightest parts of the soil are allowed to overflow the trough 18 through the slot 20 where that fraction of the soil falls to the ground beneath the device. The fallen soil is the discard and of little value.

As the soil progresses towards and past the second slot 20 the denser gold falls closer to the bottom angle of the trough and more of the less dense waste fall through the slot 22 to the ground beneath the machine where it remains. The larger and deeper next slot 24 along the soil's path removes more and less dense soils from the trough 18.

As the soil passes the largest and deepest slot 26 the majority of the soil that passed through the hopper 16 has fallen waste off of the trough 18 through the slots 20, 22 and 24. Any soil that makes it through the trough 18 and past the slot 26 is the densest fraction of the original soil in the hopper 16. Hopefully, this remaining portion will contain some nuggets of gold as it falls into the cup 28.

Figure 7:
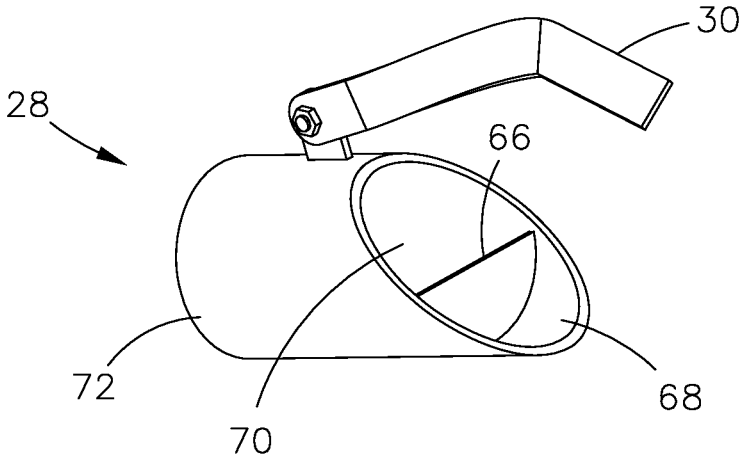
FIG. 7 is a perspective view of a representative cup.

FIG. 7 shows a version of the cup in more detail. The cup 28 is held under the low end of the trough 18 to catch the densest fraction of soil by an arm 30. The densest soil falls into the bottom 72 of the main cup 70. The cup 28 is connected to the trough assembly 14 so it gently moves with the trough assembly 14 and is softly agitated along with its densest soil contents.

As the cup 70 begins to fill after the machine has sorted sufficient soil the soft agitation with the aid of gravity further drops the most likely gold bearing fraction to the bottom 72 of the cup 70. Because it is likely that the densest fraction in the cup 70 will have gold as well as other minerals and particles, these are allowed to overflow over the baffle 66 where they can spill wasted onto the ground.

In operation in rich gold bearing soil conditions the machine might be able to continuously run for hours or longer. Occasionally the operator will need to introduce fresh, unsorted soil into the hopper 16. This method is more of a continual sorter than a batch sorter because it can continuously run, essentially indefinitely.

A groove 74 is shown in FIG. 3 to be centered about wheel 32 leaves a gap between the trough 18 and the wheel 32. This allows the then greatly reduced trail of sorted soil traveling down the path to continue down the inside corner of the trough 18 towards the cup 28. Yet the wheel 32 is still able to hold the low end of the trough 18 in line and against the wheel 36 and wheel 60.

The motor 50 can be comprised of a common wound electrical motor powered by a battery, solar cell or other electrical source. Alternatively, the action otherwise provided by the motor could be supplied by other means such as a hand crank, wind or water turbine or other manually derived source of kinetic energy.

The machine can operate effectively in dry soils, such as sand, loam, gravel and other materials. In some versions, if water were to be introduced to the process or the soil introduced to the hopper was moist then the sorting could be hindered because the soil could not easily flow against itself during the sorting by density down the path of the trough 18 from the upper to the lower end.

The dimensions of the trough 18, slots 18, 20, 22 and 24 are dependent on a plurality of factors such as the portability of the complete device, the grain size and density of the soil, the volume of soil to be processed by the machine, humidity, efficiency of the sort and angle of the trough 18.

Generally, an effective man portable design could have a trough 18 between a half meter and a several meters long. The slots could range from a few millimeters to a few centimeters in height and a few centimeters to a meter long. These are just basic guidelines that fall well within the scope of the broader invention. Far larger commercial and stationary versions of the machine could be longer with more and/or larger slots. Similarly, the angle of declination of the trough 18 can be minimal at a one degree to more than forty-five degrees of decline.

Adjustable legs on the stand assembly 12 can aid in the user fine tuning the efficacy of the device once on site and during initial calibration or test batches.

The trough 18 could be divided in to several smaller subassemblies to improve its portability and storage space needed. Many of the components could be made from a rigid, durable and resilient material such as metals, alloys, plastics, fiberglass or other similar materials. The wheels may be preferably a more supple material such as rubber or plastic, but not necessarily so to be effective.

The wheels, 54, 62, 36 and 60 can also be characterized, as roller supports when used in unison. An important version of the gold dry washer can be fairly described as being comprised, among other features, a stand assembly 12 and a trough assembly 14. The stand assembly 12 at a first end has a first ground contacting leg 44 and first roller support 54, 62 above the first end. The stand assembly 12 at a second end has a second ground contacting leg 42 and a second roller support 36, 60 above the second end. The first end of the stand assembly is connected to the second end of the stand assembly by a beam 40. The leg 44 on the first end of the stand assembly 12 is longer than the leg 42 on the second end of the stand assembly 12 so that there is a predetermined angle of declination between the first roller support 54, 62 and the second roller support 36, 60. The trough assembly 14 is comprised of a trough 18 having a hopper 16 at a first end and cup 28 at a second end. The trough 18 has an interior angular bottom along its an entire length along which the soil being sorted travels. The length of the trough 18 is at least as long as a distance between the first roller support 54, 62 and the second roller support 36, 60. The trough 18 on a first end rests on the first roller support 54, 62 and on a second end on the second roller support 36, 60. The trough has a series of apertures 20, 22, 24 and 26, for example but other configurations or numbers of apertures (sometimes also equivalently referred to as slots because the apertures may be slot-like in appearance), along each side of the angular bottom along the length of the trough 18 that between the first end and second end of the trough graduate from smaller on to larger and becoming closer to the angular bottom of the trough 18. A reciprocating means interconnects the trough assembly 14 to the stand assembly 12 operatively so that the trough assembly reciprocates a predetermined range relative to the stand assembly 12. An example of a reciprocating means can be the combination of the motor 50, rod 48, crank 52, bracket 46 and bearing 53. The hopper 16 is in communication with and gravity feeds a soil to the first end of the trough.

Options can include that the reciprocating means is any of an electric motor, a wind turbine, a water turbine, human hand crank or animal movement that causes the trough assembly 14 to reciprocate gently relative to the stand assembly 12. The angle of declination is between one and forty-five degrees relative to the horizontal so that material fed into the hopper 16 can travel toward the lower end of the trough assembly 14 during operation of the device.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A gold dry washer comprised of a stand assembly and a trough assembly;

the stand assembly at a first end has a first ground contacting leg and first roller support above the first end;

the stand assembly at a second end has a second ground contacting leg and a second roller support above the second end;

the first end of the stand assembly is connected to the second end of the stand assembly by a beam;

the leg on the first end of the stand assembly is longer than the leg on the second end of the stand assembly so that there is a predetermined angle of declination between the first roller support and the second roller support;

the trough assembly is comprised of a trough having a hopper at a first end and cup at a second end;

the trough has an interior angular bottom along its an entire length;

the length of the trough is at least as long as a distance between the first roller support and the second roller support;

the trough on a first end rests on the first roller support and on a second end on the second roller support;

the trough has a series of apertures along each side of the angular bottom along the length of the trough that between the first end and second end of the trough graduate from smaller on to larger and becoming closer to the angular bottom;

a reciprocating means interconnects the trough assembly to the stand assembly operatively so that the trough assembly reciprocates a predetermined range relative to the stand assembly;

the hopper is in communication with and gravity feeds a soil to the first end of the trough.

2. A gold dry washer as in claim 1 further characterized in that the reciprocating means is any of an electric motor, a wind turbine, a water turbine, human hand crank or animal movement.

3. A Told dry washer as in claim 1 further characterized in that the angle of declination is between one and forty-five degrees relative to the horizontal.

* * * * *